US008469628B2

(12) United States Patent
Miller et al.

(10) Patent No.: US 8,469,628 B2
(45) Date of Patent: Jun. 25, 2013

(54) UTILITIES ACCESS CLOSURE

(75) Inventors: Richard L. Miller, Meadow Vista, CA (US); Stephen L. Miller, Grass Valley, CA (US)

(73) Assignee: J.S. Land Management Corporation, Pleasanton, CA (US)

( * ) Notice: Subject to any disclaimer, the term of this patent is extended or adjusted under 35 U.S.C. 154(b) by 197 days.

(21) Appl. No.: 12/494,105

(22) Filed: Jun. 29, 2009

(65) Prior Publication Data

US 2010/0329782 A1 Dec. 30, 2010

(51) Int. Cl.
*E02D 29/14* (2006.01)

(52) U.S. Cl.
USPC ..... 404/25

(58) Field of Classification Search
USPC ..... 404/25, 26; 52/742.14, 405.3; 249/1; 137/371
See application file for complete search history.

(56) References Cited

U.S. PATENT DOCUMENTS

| | | | | | |
|---|---|---|---|---|---|
| 469,501 | A | * | 2/1892 | Fowler | 404/25 |
| 694,455 | A | * | 3/1902 | Barker | 404/25 |
| 2,109,287 | A | * | 2/1938 | Elkington | 404/25 |
| 2,211,513 | A | * | 8/1940 | Nagin | 52/318 |
| 2,274,108 | A | * | 2/1942 | Tripp | 52/137 |
| 3,544,417 | A | | 12/1970 | Corzine | |
| 3,839,768 | A | | 10/1974 | McQuestion | |
| 3,920,347 | A | | 11/1975 | Sauriol et al. | |
| 3,974,599 | A | | 8/1976 | Grosh | |
| 4,662,777 | A | | 5/1987 | Newton | |
| 4,726,707 | A | | 2/1988 | Newton | |
| 4,973,191 | A | | 11/1990 | Dannhauser | |
| 5,123,776 | A | | 6/1992 | Lang et al. | |
| 5,312,202 | A | | 5/1994 | Newton | |
| 5,378,078 | A | | 1/1995 | Lewis et al. | |
| 5,383,311 | A | | 1/1995 | Strickland | |
| 5,486,066 | A | | 1/1996 | Hagenah | |
| 5,511,345 | A | | 4/1996 | Jones et al. | |
| 5,529,431 | A | | 6/1996 | Walsh | |
| 5,588,775 | A | | 12/1996 | Hagenah | |
| 5,609,680 | A | | 3/1997 | Kobayashi et al. | |
| 5,611,125 | A | | 3/1997 | Williams et al. | |
| 5,614,009 | A | | 3/1997 | Kobayashi et al. | |
| 5,624,615 | A | | 4/1997 | Sandorff | |
| 5,632,571 | A | | 5/1997 | Mattox | |
| 5,829,215 | A | | 11/1998 | Billing | |
| 6,267,531 | B1 | | 7/2001 | Clarke | |
| 6,739,797 | B1 | | 5/2004 | Schneider | |
| 7,163,352 | B2 | | 1/2007 | Jurich et al. | |
| 7,748,926 | B2 | | 7/2010 | Jurich et al. | |
| 7,914,227 | B2 | * | 3/2011 | Jordan et al. | 404/25 |

FOREIGN PATENT DOCUMENTS

| | | |
|---|---|---|
| EP | 0 529 178 A1 | 3/1993 |
| GB | 2 232 182 A1 | 12/1990 |
| JP | 6-49857 | 2/1994 |

* cited by examiner

*Primary Examiner* — Thomas B Will
*Assistant Examiner* — Abigail A Risic
(74) *Attorney, Agent, or Firm* — Bever, Hoffman & Harms, LLP; E. Eric Hoffman

(57) ABSTRACT

A concrete lid for an in-ground utilities box includes a reinforcement structure filled with concrete. The reinforcement structure includes a plastic frame and one or more reinforcing trusses that extend between opposing sidewalls of the plastic frame. The reinforcing trusses also extend substantially between the upper and lower edges of the opposing sidewalls. For example, a reinforcing truss may include a flat truss member that is substantially coplanar with the lower edges of the sidewalls, and an arched truss member that extends towards (but does not reach) a plane defined by the upper edges of the sidewalls. The reinforcing trusses include openings that allow wet concrete to pass through. The sidewalls of the plastic frame protect the edges of the lid from damage. The reinforcing trusses reinforce the concrete lid, eliminating the need for separate reinforcement material.

23 Claims, 13 Drawing Sheets

UTILITIES ACCESS CLOSURE

BACKGROUND OF THE INVENTION

1. Field of the Invention

The present invention relates to closures for underground housings having surface access openings, and more particularly, to lids or caps for such openings.

2. Description of the Related Art

Utilities of various types are commonly buried underground. Such utilities include, for example, water, sewer, natural gas, telephone, cable television, irrigation, electric service, security and fire alarm service. Underground utilities commonly employ an access portal to allow service personnel to access the utilities for maintenance and meter reading. This access portal typically includes a pre-cast concrete box that is buried underground. Utility devices, such as valve mains, meters and wire connectors, are located within the concrete box. The box includes an opening through which the utility devices are accessed. When the box is not being accessed, the opening is covered by a lid. The lid and box are located such that the lid is flush, or nearly flush, with the level of the surrounding ground. The lid is typically made of pre-cast concrete or composite resin. The lid can include a lip that is shaped to engage the opening in the box. Alternatively, the opening of the box can be shaped to receive the lid, which does not have a lip.

A common configuration is a lid having tapered sidewalls, and a box having an opening with corresponding tapered sidewalls. In this configuration, the lid easily slides into the opening of the box and fixes itself firmly in place as the tapering sidewalls of the lid engage the tapering sidewalls of the opening. This design is relatively inexpensive to form and fairly robust, compared with more complicated closures.

While the concrete lids and boxes are quite strong, these lids tend to be heavy, and repeated opening of the box causes wear or damage. Operators, in opening and closing the box, tend to be careless in handling the lid. As the edges of the lid strike the edges of the box opening (or the ground), the concrete can chip or fracture on either one or both of the lid and the box. Over time, the lid may sustain too much damage to function properly, thereby requiring replacement of the lid. The box may also eventually reach a point where it must be replaced, as a result of damage to the opening therein. Replacement of the box can be costly and labor intensive, requiring the breaking of pavement in those cases where the box is under pavement. At the very least, the box must be excavated and replaced with a new box.

Additionally, in environments where freezing occurs, water may freeze between the lip of the sidewalls of the lid and the sidewalls of the box opening. In such an event, it is extremely difficult to remove the lid from the box. In extreme cases, the effort required to remove the lid from the box may be sufficient to destroy the lid.

Concrete lids are typically formed using a rubber mat and a sturdy aluminum dryer, which has a thickness on the order of 1 inch or more. FIG. 1 is a cross sectional view of an aluminum dryer 101, which is fitted into a corresponding rubber mat 102. Rubber mat 102 is placed flat on a platform 103. The upper surface of the rubber mat includes various raised sections 104, which create patterns and graphics on the upper surface of the lid. The outer edges of aluminum dryer 101 engage ridges on rubber mat 102, such that aluminum dryer 101 is held on rubber mat 102.

When creating lids, a reinforcing structure 105 can be set on rubber mat 102, within the perimeter of aluminum dryer 101. Reinforcing structure 105 includes a welded wire rack 106, which is supported by a set of four wheels 107. Wheels 107 are required to support wire rack 106 when wet concrete is poured into aluminum dryer 101. Reinforcing structure 105 is free-floating within aluminum dryer 101.

After aluminum dryer 101, rubber mat 102 and reinforcing structure 105 have been assembled, wet concrete 110 is poured into the upper opening of aluminum dryer 101 (and onto rubber mat 102). The concrete 110 is leveled off at the upper surface of aluminum dryer 101. The concrete 110 is then allowed to dry. When the concrete 110 has sufficiently set, rubber mat 102 is peeled off and the concrete 110, and embedded reinforcing structure 105, are removed from aluminum dryer 101 (typically by hammer). The removed concrete 110 and reinforcing structure 105 form a concrete lid. Aluminum dryer 101 is then cleaned, typically by scraping off any excess dried concrete. The process is then repeated, reusing aluminum dryer 101 and rubber mat 102.

This process has several disadvantages. First, as described above, the process is labor intensive. In addition, the number of lids that can be produced at a time is limited by the number of aluminum dryers. The aluminum dryers are expensive and take up significant storage space, thus providing a practical limitation on the number of aluminum dryers that can be used. Moreover, the rubber mats shrink over time, thereby resulting in irregular edges around the upper surface of the resulting lids. The rubber mats primarily shrink at the edges where the rubber mat contacts the aluminum dryer. The different coefficients of expansion/contraction between rubber mat 102 and aluminum dryer 101 contribute to this shrinkage. The rubber mat shrinkage can also cause the patterns/printing formed on the upper surface of the lid to be raised or recessed with respect to the upper surface of the lid, thereby creating a tripping hazard. Eventually, the rubber mats degrade to a point where they must be replaced. In addition, reinforcing structure 105 is relatively expensive, as this is a separate multi-piece element that must be manually inserted into aluminum dryer 101. Finally, the edges of the resulting lid are concrete. As a result, these edges are susceptible to chipping and cracking when the lid is inserted and removed from the concrete box. Moreover, these edges can chip or crack at the time of manufacture, thereby causing these lids to be thrown away and raising the cost of production.

Some concrete lids have been created using a sheet metal form. FIG. 2 is a view of a conventional sheet metal form 201, which is fitted into a corresponding rubber mat 202. Rubber mat 202 is placed flat on a platform 203. Again, the upper surface of rubber mat 202 includes various raised sections 204, which create patterns and graphics on the upper surface of the lid. The outer edges of metal form 201 engage ridges on rubber mat 202, such that metal form 201 is held on rubber mat 202.

Metal form 201 is significantly thinner than aluminum dryer 101. For example, metal form 201 may be formed from a steel galvanized sheet metal having a thickness of about 1/16 inch. Metal form 201 includes tapered sidewalls 201A and a lattice structure 201B continuous with the sidewalls 201A.

After metal form 201 and rubber mat 202 have been assembled, wet concrete 210 is poured through the lattice structure 201B into metal form 201 (and onto rubber mat 202). The concrete 210 is leveled off at the upper surface of metal form 201. The concrete 210 is then allowed to dry. When the concrete 210 has sufficiently set, rubber mat 202 is peeled off, thereby completing fabrication of the lid. Metal form 201 remains intact on the completed lid.

This process also has several disadvantages. First, metal form 201 is created using a five-step process, with one of these steps requiring the use of a 30-ton press. As a result, metal form 201 is relatively difficult and expensive to fabricate (on the order of $3.25 per form). Moreover, because metal form 201 is not as heavy as aluminum dryer 101, the wet concrete tends to displace metal form 201 on rubber mat 202, such that some concrete seeps under the metal form, as illustrated at locations 211 and 212. This concrete readily chips, thereby contributing to an irregular edge at the upper surface of the lid. This problem worsens as rubber mat 202 shrinks over time. In addition, lattice structure 201B, which functions to maintain the shape of metal form 201 during the concrete pour (and drying), does not provide any significant reinforcement to the resulting concrete lid (largely because this lattice structure 201B is located at the bottom of the lid). Moreover, the portions of concrete 210 immediately adjacent to lattice structure 201B are susceptible to chipping.

Lids have also been made from composite resin. Composite resin lids are lighter and less susceptible to chipping and cracking than concrete lids. However, composite resin lids are significantly more expensive than concrete lids. More specifically, a composite resin lids will typically be two to three times more expensive than a concrete lid of similar size. Moreover, composite resin lids are a petroleum-based product. Thus, the cost of composite resin lids is ultimately based on the price of petroleum. In addition, composite resin lids have a tendency to discolor in response to extended exposure to the sun.

It would therefore be desirable to have a low-cost, durable lid for utility closures that overcomes the above-described deficiencies of the prior art.

SUMMARY

Accordingly, the present invention provides an improved lid for in-ground utility boxes or vaults. In accordance with one embodiment, the lid includes a concrete core, a plastic frame structure that laterally surrounds the concrete core, and one or more reinforcing trusses that are attached to opposing sidewalls of the plastic frame structure, and are substantially surrounded by the concrete core.

In a particular embodiment, both the plastic frame structure and the reinforcement trusses are formed by injection-molded polypropylene. In one example, the plastic frame structure and the reinforcement trusses are formed as separate units, and the ends of the reinforcement trusses are fitted into slots formed the plastic frame structure. If the lid includes a plurality of reinforcement trusses, these trusses may be positioned in parallel with one another along a length of the lid. In one embodiment, the reinforcement trusses are entirely encapsulated by concrete between the upper and lower surfaces of the lid. In another embodiment, portions of the reinforcement trusses may be exposed through the concrete at the lower surface of the lid. The reinforcement trusses thereby provide low cost, reliable structural reinforcement to the concrete lid.

The present invention also includes various methods for forming the concrete lid of the present invention. One such method includes the steps of: (1) attaching one or more reinforcing trusses to a plastic frame, wherein the one or more reinforcing trusses extend between opposing sidewalls of the plastic frame, and wherein the one or more reinforcing trusses are laterally surrounded by the plastic frame; (2) coupling the plastic frame to a mold, wherein a first edge of the plastic frame engages the mold, (3) filling the plastic frame with concrete, wherein the concrete substantially surrounds the reinforcing trusses within the plastic frame, (4) curing the concrete, thereby creating cured concrete that bonds to the plastic frame and the reinforcing trusses, and (5) removing the mold from the plastic frame and the cured concrete.

The present invention will be more fully understood in view of the following description and drawings.

DETAILED DESCRIPTION

Figure 1:
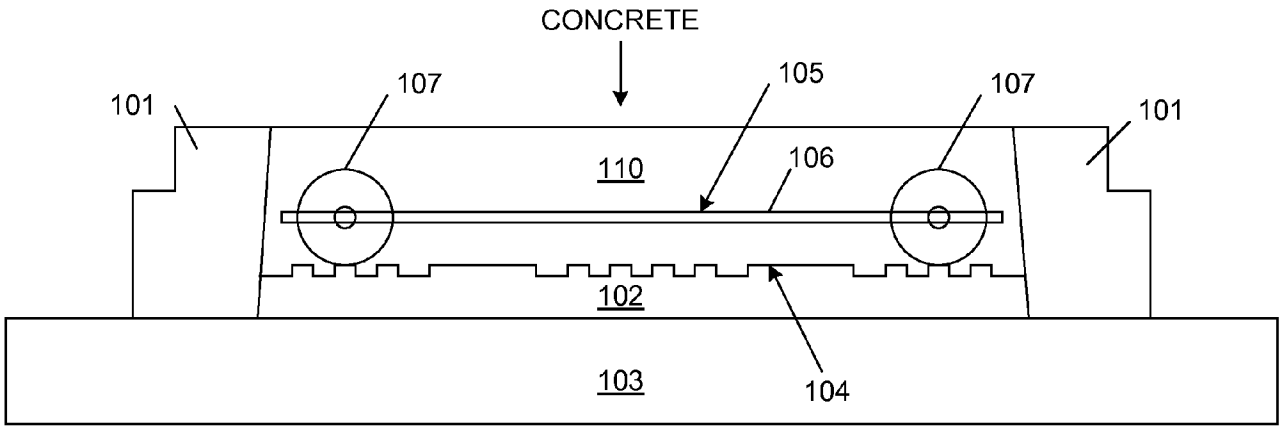
FIG. 1 (PRIOR ART)
FIG. 1 is a cross sectional view of a conventional concrete lid during fabrication.
Figure 2:
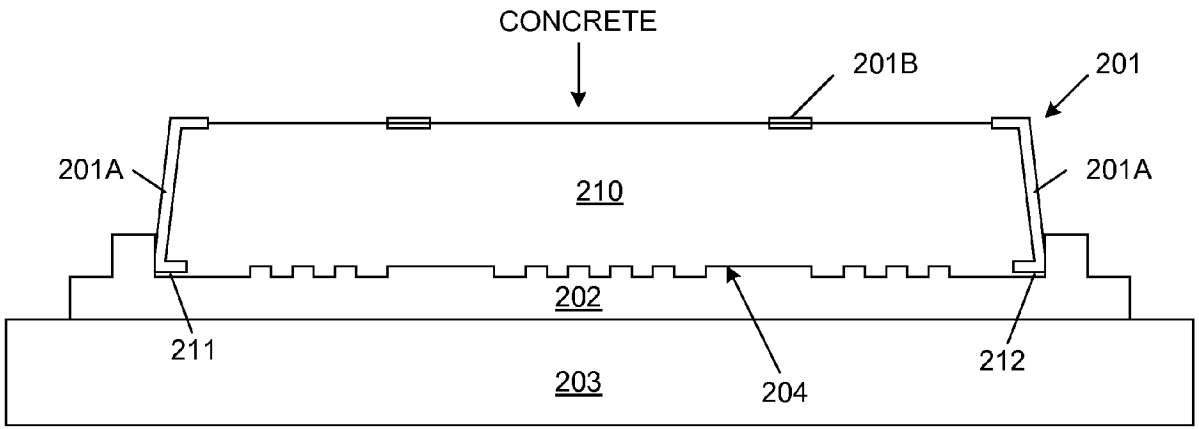
FIG. 2 (PRIOR ART)
FIG. 2 is a cross sectional view of another conventional concrete lid during fabrication.
Figure 3A:
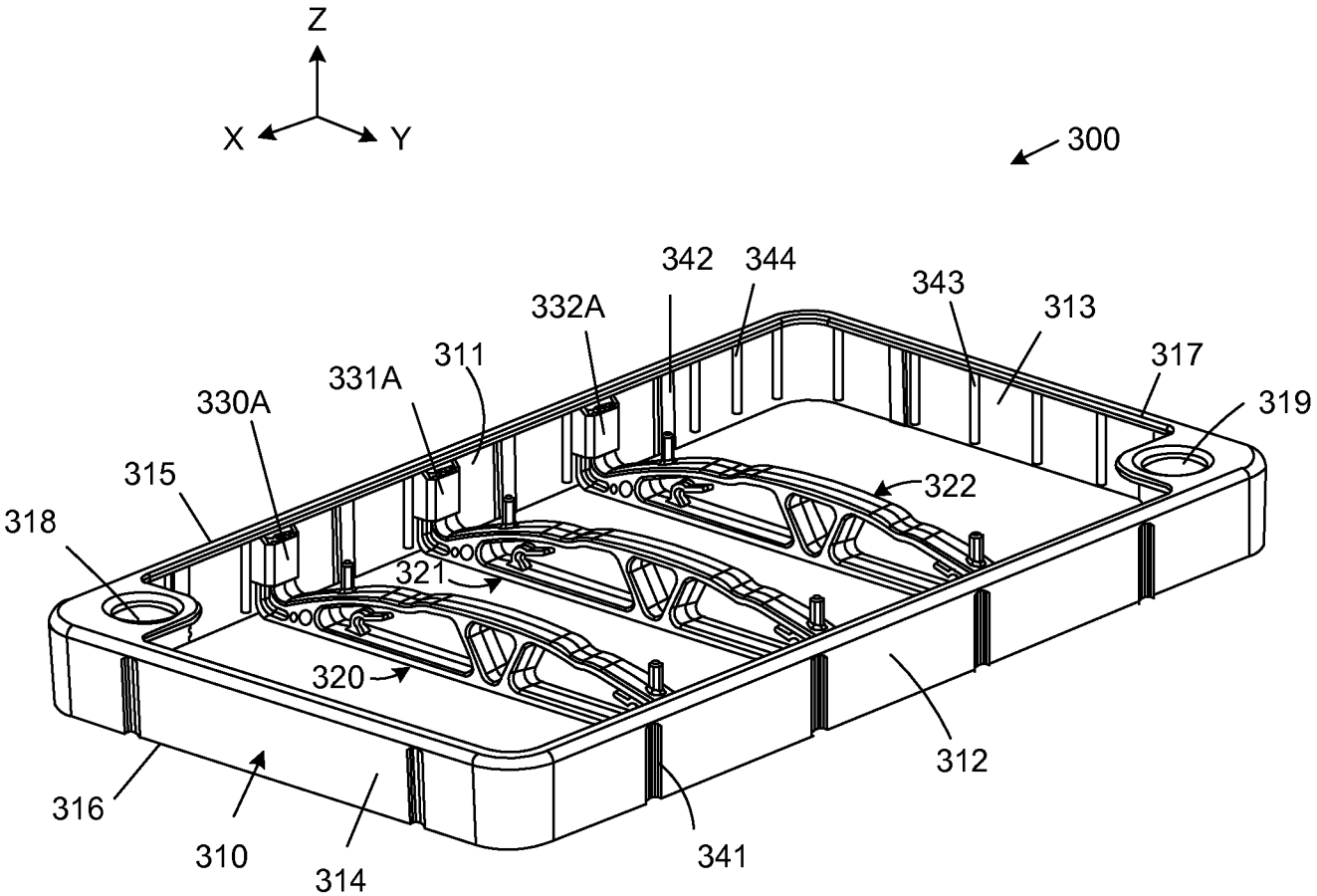
FIGS. 3A and 3B are top and bottom isometric views, respectively, of a reinforcing structure for a utilities access lid, in accordance with one embodiment of the present invention.
Figure 3B:
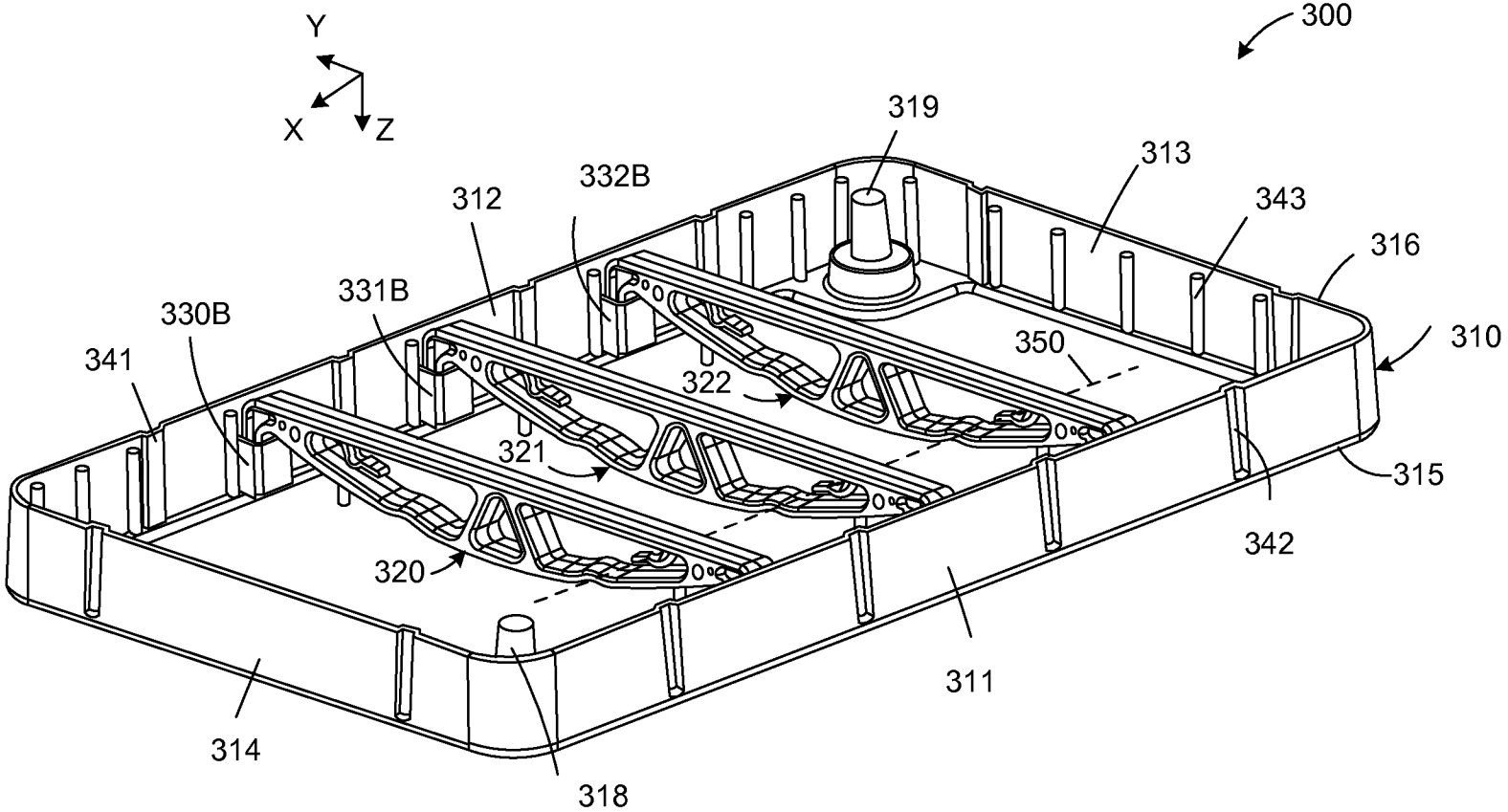

FIGS. 3A and 3B are top and bottom isometric views, respectively, of a reinforcing structure 300 for a utilities access lid, in accordance with one embodiment of the present invention. As described in more detail below, reinforcing structure 300 is filled with concrete to create a utilities access lid. Reinforcing structure 300 includes a rectangular plastic frame structure 310 and reinforcing trusses 320-322.

Figure 4A:
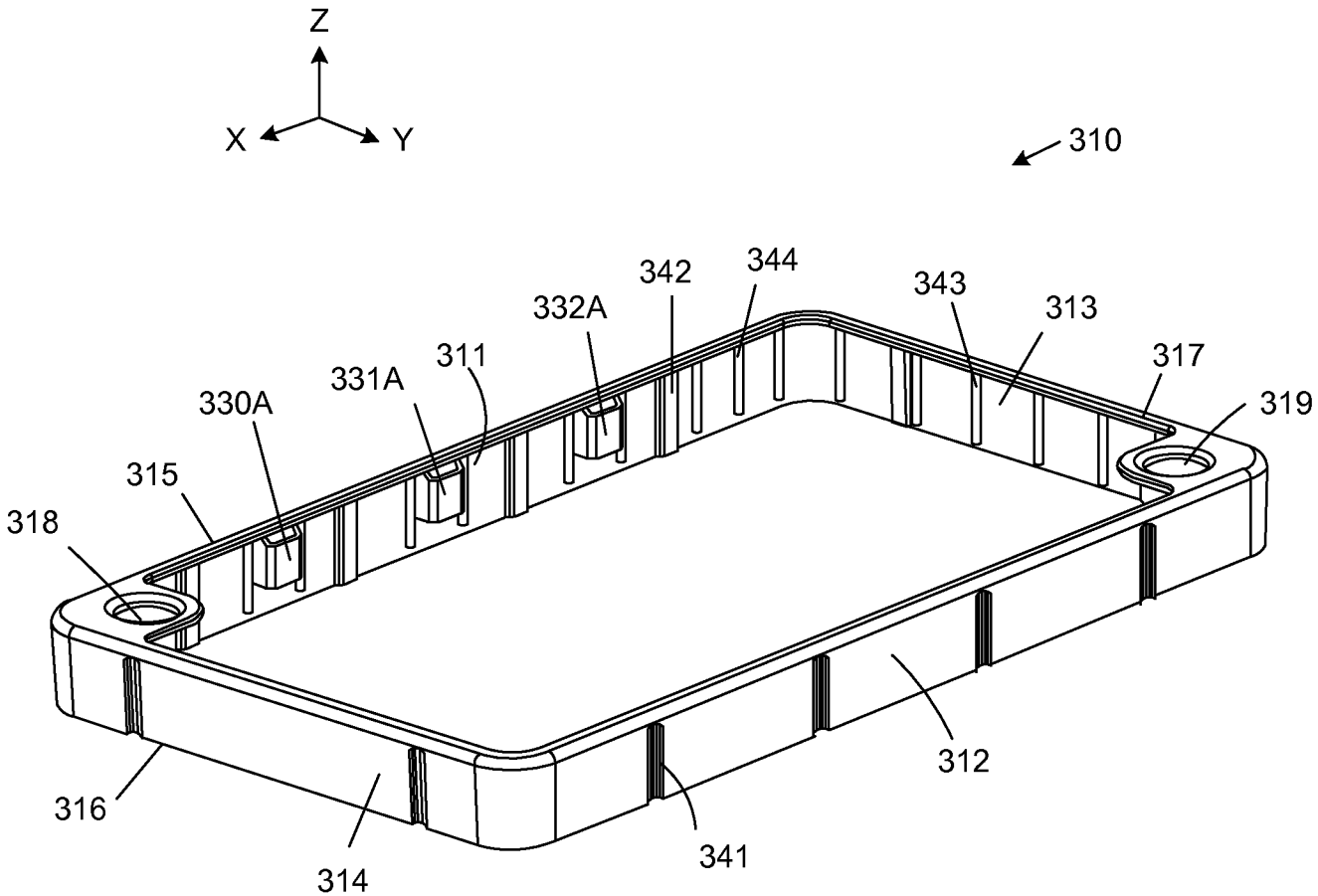
FIGS. 4A and 4B are top and bottom isometric views, respectively, of a plastic frame structure of the reinforcing structure of FIGS. 3A and 3B, in accordance with one embodiment of the present invention.
Figure 4B:
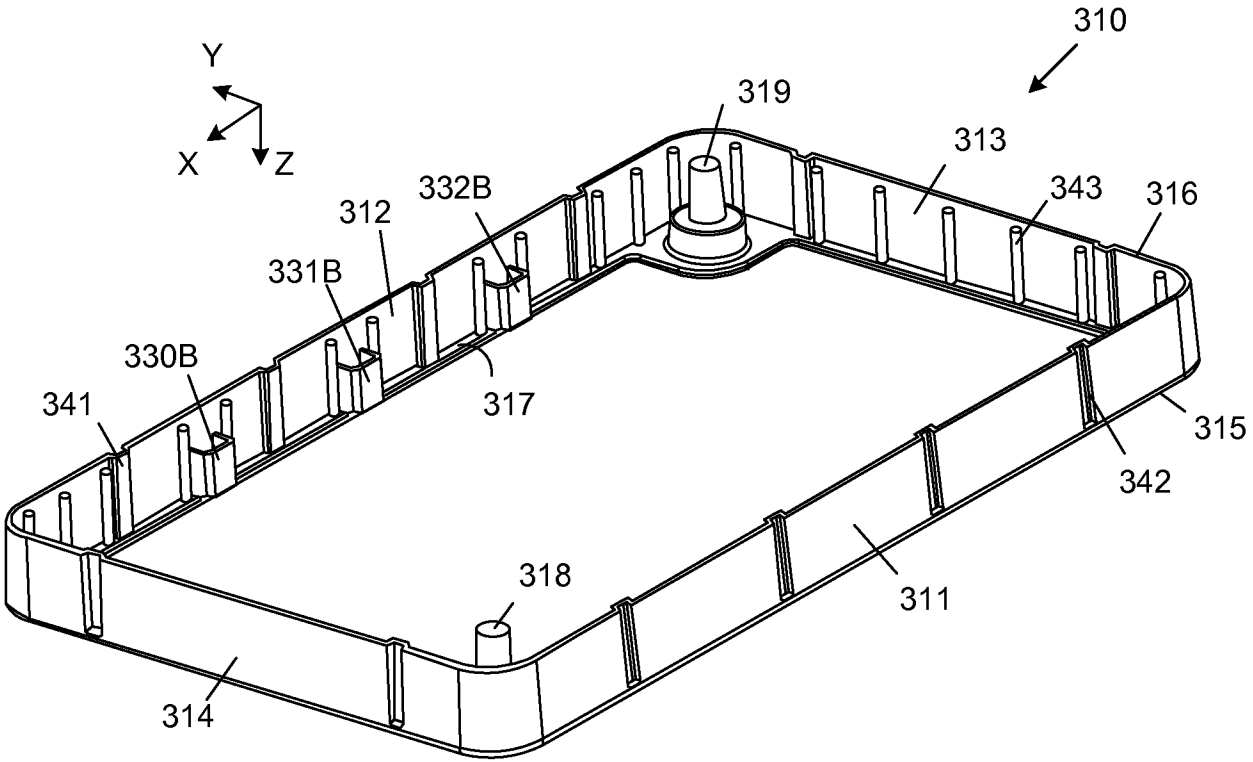

FIGS. 4A and 4B are top and bottom isometric views, respectively, of rectangular plastic frame structure 310, in accordance with one embodiment of the present invention.

Figure 5A:
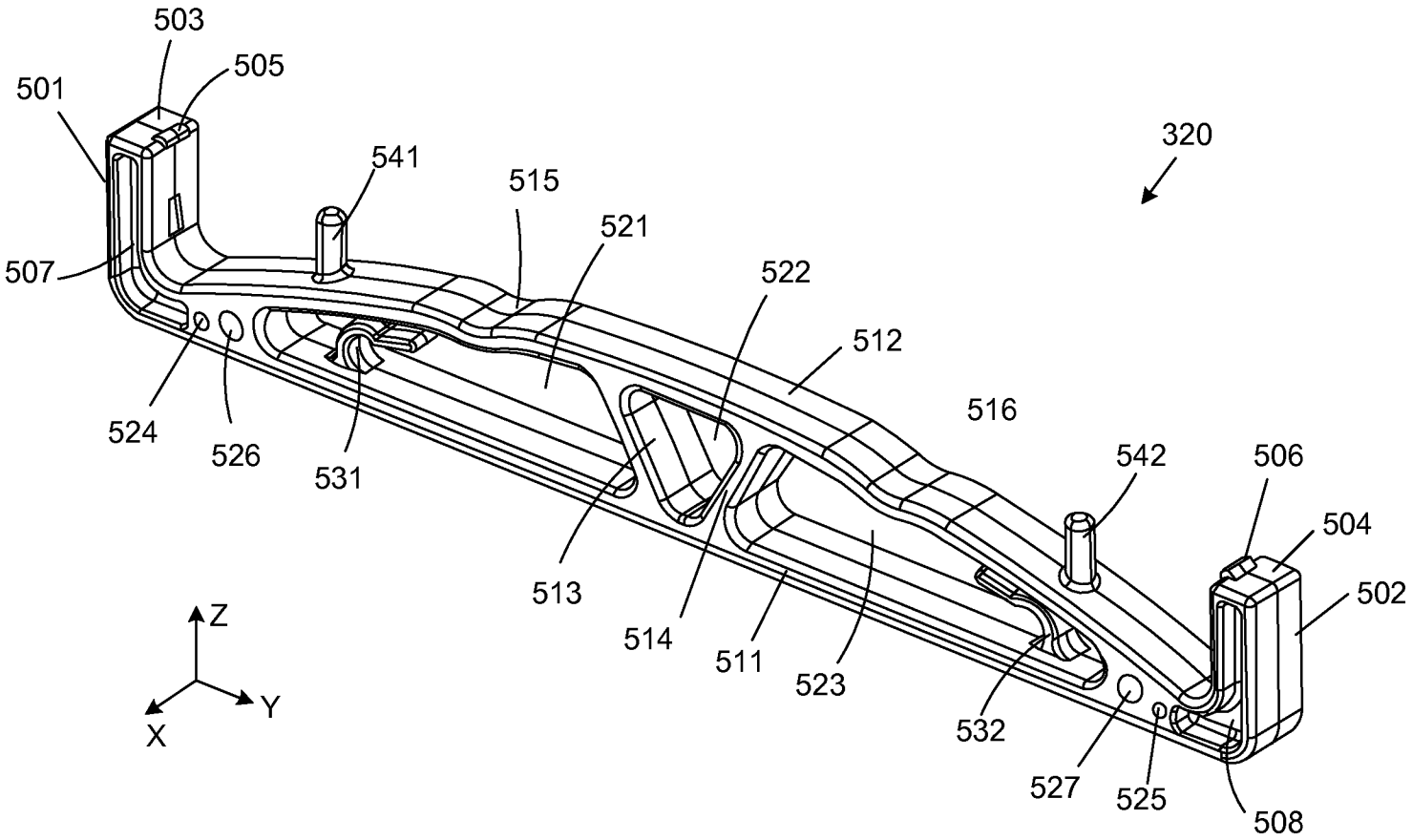
FIGS. 5A and 5B are top and bottom isometric views, respectively, of a reinforcing truss of the reinforcing structure of FIGS. 3A and 3B, in accordance with one embodiment of the present invention.
Figure 5B:
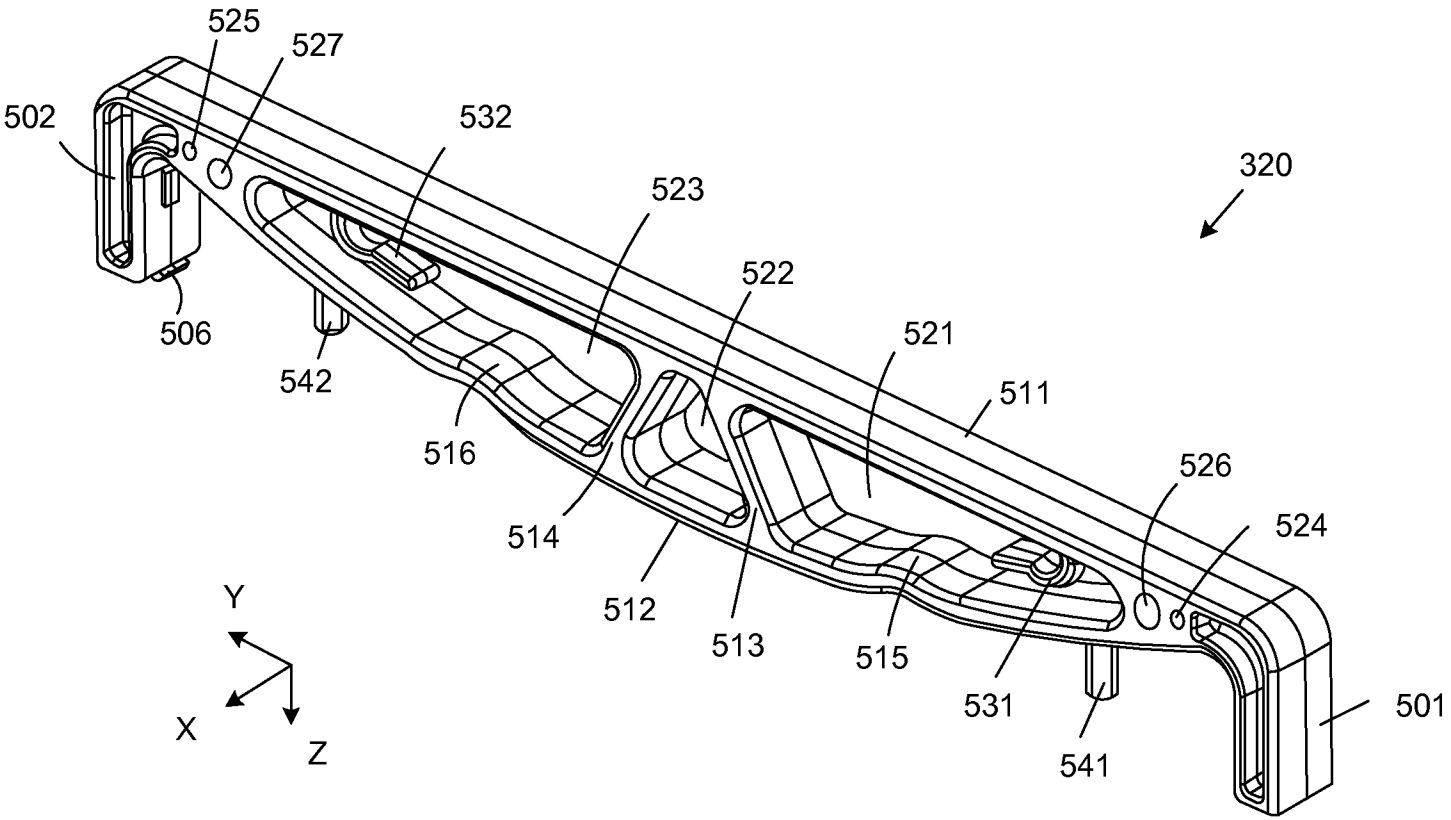

FIGS. 5A and 5B are top and bottom isometric views, respectively, of reinforcing truss 320, in accordance with one embodiment of the present invention. In the described embodiments, reinforcing trusses 320-322 are identical (although this is not necessary).

Plastic frame structure 310 has a rectangular shape with curved corners. In the described embodiment, plastic frame structure 310 is about 23¼ inches long, 13½ inches wide, and 2 inches deep. However, other dimensions are possible in other embodiments. Plastic frame structure 310 includes four circumscribing sidewalls 311-314, which exhibit an upper edge 315 and a lower edge 316. Sidewalls 311-314 are slightly tapered from upper edge 315 to lower edge 316, thereby facilitating removal and replacement of a finished lid in a corresponding utilities box. The upper edge 315 includes a rolled edge 317, which adds strength to rectangular structure. This rolled edge 317 helps to prevent distortion of plastic frame structure 310 when wet concrete is poured into this structure. In the described embodiment, sidewalls 311-314 include a series of gussets and ribs (e.g., gussets 341-342 and ribs 343-344), which contribute to the overall strength of plastic frame structure 310. More specifically, these gussets and ribs help to prevent the lateral deflection of sidewalls 311-314 when wet concrete is poured into plastic frame structure 310. Although a particular gusset and rib configuration is shown, it is understood that other configurations are possible.

Plastic frame structure 310 also includes truss slots 330A-330B, 331A-331B and 332A-332B. Truss slots 330A, 331A and 332A are located on the inner surface of sidewall 311. Truss slots 330B, 331B and 332B are located on the inner surface of opposing sidewall 312. Truss slots 330A, 331A and 332A are aligned with the opposing truss slots 330B, 331B and 332B, respectively, such that the ends of reinforcing trusses 320-322 may be fitted into the truss slots 330A-330B, 331A-331B and 332A-332B in the manner illustrated in FIGS. 3A and 3B.

Plastic frame structure 310 also includes optional J-bolt forms 318-319, which are described in more detail in U.S. Pat. No. 7,163,352 B2, which is hereby incorporated by reference.

In the present embodiment, plastic frame structure 310 is injection-molded polypropylene, preferably with an ultraviolet inhibitor to retard damage due to sunlight. Polypropylene is chosen because of its strength and impact characteristics. In this embodiment, sidewalls 311-314 each have a thickness T in the range of about 1/16 to 1/8 of an inch, or more specifically about 3/32 inch. In other embodiments, frame structure 310 may be made from any plastic material having the appropriate strength and impact resistance characteristics to meet the functional requirements described below.

As illustrated in FIGS. 5A and 5B, reinforcing truss 320 includes end posts 501-502 and truss members 511-514. End posts 501 and 502 include end surfaces 503 and 504, respectively, and end tabs 505 and 506, respectively. End posts 501 and 502 are sized to be snugly fitted into corresponding slots 330A and 330B, respectively, in plastic frame structure 310. When end posts 501-502 are fully inserted into the respective slots 330A-330B, the end surfaces 503 and 504 are placed into contact with the underside of rolled edge 317. In addition, end tabs 505 and 506 protrude over the edges of the respective slots 330A and 330B (see, FIG. 3A), thereby retaining reinforcing truss 320 within slots 330A-330B. When reinforcing truss 320 is fully engaged within slots 330A-330B in the manner described above, reinforcing truss 320 is placed in a desired alignment within plastic frame structure 310. In accordance with one embodiment of the present invention, the lower surface of truss member 511 is substantially coplanar with the lower edge 316 of plastic frame structure 310. As a result, the lower surface of truss member 511 will be exposed through concrete when the fabrication of the associated lid is complete. In an alternate embodiment, the lower surface of truss member 511 may be positioned slightly above the plane of the lower edge 316 of plastic frame structure 310 in the view of FIG. 3A. In this alternate embodiment, the lower surface of truss member 511 will not be exposed through concrete when the fabrication of the associated lid is complete.

Truss members 511-512 extend between end posts 501-502. Truss members 511-512 and end posts 501-502 are joined with curved edges, as illustrated, thereby providing strength to reinforcing truss 320. Grooves 507-508 are formed in end posts 501-502 as illustrated. Similarly, openings 524-527 are located adjacent to end-posts 501-502 as illustrated. As will become apparent in view of the subsequent disclosure, concrete will subsequently enter grooves 507-508 and openings 524-527, thereby enhancing the strength of the resulting lid structure. In one embodiment, openings 524-527 do not extend entirely through reinforcing truss 320. Truss member 511 is a substantially flat structural member, while truss member 512 extends in an arch between the ends of truss member 511. Truss members 513 and 514 join truss members 511 and 512 near a central location of reinforcing truss 320. More specifically, truss members 513 and 514 extend upward and outward from a central location of truss member 511, and join truss member 512, such that a triangular opening 522 is formed. Larger triangular openings 521 and 523 are also formed by truss members 511-514, as illustrated. The openings 521-523 in reinforcing truss 320 have curved corners to reduce stress at those points and increase the life of reinforcing truss 320. As described in more detail below, openings 521-523 are subsequently filled with concrete in the finished lid. Thus, the openings 521-523 are large enough to permit the passage of wet concrete. In the described embodiments, each of the truss members 511-514 has a width of about 3/4 inches (along the X-axis) and a thickness of about 1/4 inch (along the Z-axis).

Struts 541 and 542 extend upward from truss member 512, as illustrated. Struts 541 and 542 are configured to engage with corresponding (optional) nameplates, which are ultimately exposed at the upper surface of the finished lid. Nameplates that may be engaged with struts 541 and 542 are described in more detail in U.S. Pat. No. 7,163,352 B2, which is hereby incorporated by reference. Referring to FIG. 3A, a first nameplate may be engaged with the three co-linear struts located adjacent to sidewall 311, while a second nameplate may be engaged with the three co-linear struts positioned adjacent to sidewall 312. Note that the arched truss member 512 (FIG. 5A) includes gussets 515 and 516, which provide clearance between the nameplates and the arched truss member 512 near the upper surface of the finished lid.

The upper surface of truss member 512 and the upper surfaces of struts 541-542 are located below the upper edge 315 of plastic frame structure 310 in the view of FIG. 3A. As a result, the upper surface of truss member 512 and the upper surfaces of struts 541-542 will not be exposed when the fabrication of the associated lid is complete. In accordance with the present example, reinforcing truss 320 has a height along the Z-axis of about 1 5/8 inches, such that the upper surface of truss member 512 is located about 1/2 inch below the upper edge 315 of plastic frame structure 310. As a result, about 1/2 inch of concrete will be formed over the uppermost surface of truss member 512 in the finished lid. It has been found that providing about 1/2 inch of concrete over the uppermost surface of truss member 512 is sufficient to prevent the chipping of concrete at the upper surface of the finished lid in most cases.

Clips 531-532 are located on the upper surface of truss member 511, within triangular openings 521 and 523, respectively. In accordance with one embodiment, reinforcing rods may be inserted into clips 531-532. For example, dashed line 351 in FIG. 3B illustrates the location of one such reinforcing rod. Reinforcing rods can be made of any rigid material (e.g., metal). These reinforcing rods add structural strength the resulting lid.

Reinforcing trusses 321 and 322 are inserted into corresponding slots 331A-331B and 332A-332B in the same manner that reinforcing truss 320 is inserted into corresponding slots 330A-330B. As a result, reinforcing trusses 320-322 are placed into a desired alignment within plastic reinforcing frame 310. More specifically, reinforcing trusses 320-322 are aligned in parallel with one another along the illustrated Y-axis. Reinforcing trusses 320-322 are also aligned in parallel with sidewalls 313 and 314, which also extend along the illustrated Y-axis. Reinforcing trusses 320-322 are also aligned perpendicular to sidewalls 311 and 312, which extend along the illustrated X-axis. This alignment adds strength to the resulting plastic reinforcing structure 310.

In accordance with the embodiment illustrated by FIGS. 3A-3B, the flat truss member (e.g., truss member 511) of each of the reinforcing trusses 320-322 is located at or near the lower edge 316 of plastic frame structure 310, thereby providing increased strength at the lower surface of the resulting lid. This configuration is selected because when a stress load is applied onto the upper surface of the resulting lid, the bottom of the resulting lid is the most likely to break or give way. Providing the flat truss members near the lower surface of the resulting lid advantageously enables the lid to withstand larger stress, without breaking.

In accordance with one embodiment of the present invention, reinforcing trusses 320-322 are made of the same material as plastic frame structure 310 (e.g., injection-molded polypropylene). As a result, the fabrication of reinforcing structure 300 becomes easier, as both the plastic frame structure 310 and the trusses 320-322 may be simultaneously fabricated during the same injection molding process. Moreover, plastic frame structure 310 and reinforcing trusses 320-322 will have the same coefficient of expansion, resulting in a more stable reinforcing structure 300.

Figure 6A:
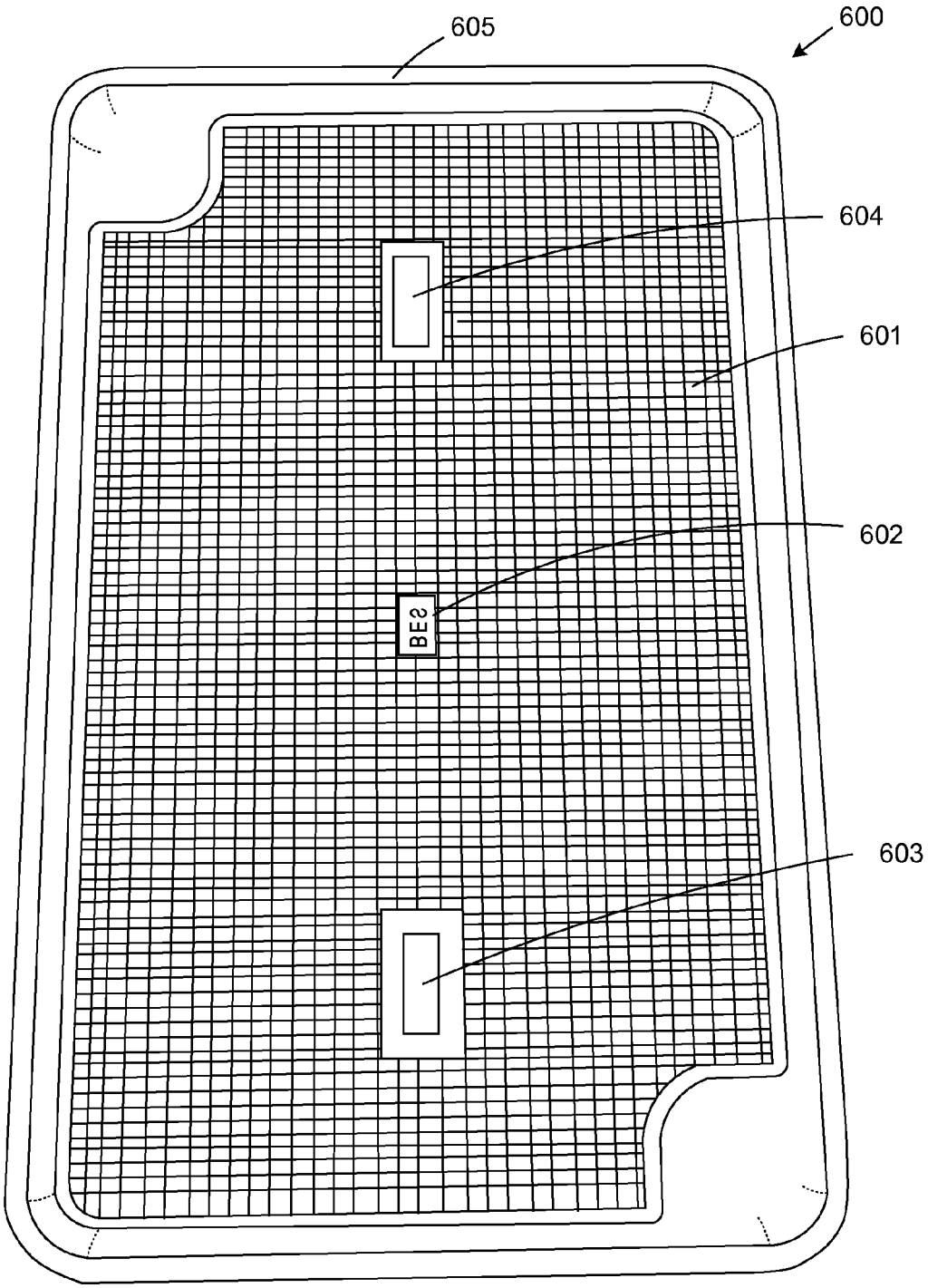
FIG. 6A is an isometric view of a mold used to fabricate a lid in combination with the reinforcing structure of FIGS. 3A and 3B, in accordance with one embodiment of the present invention.

The fabrication of a utilities enclosure lid using reinforcing structure 300 will now be described in accordance with one embodiment of the present invention. FIG. 6A is an isometric view of a mold 600 used to fabricate a lid in combination with reinforcing structure 300. According to one embodiment of the invention, mold 600 is formed from a flexible, resilient material, such as polyurethane. In accordance with one embodiment, the material used to form mold 600 exhibits a low adhesion to cured concrete. As a result, mold 600 may be easily removed from a subsequently formed concrete core (described below), such that there is no need to apply a non-stick treatment to mold 600 prior to introducing concrete. Mold 600 includes the features to be cast into the top surface of the resulting lid, including texturing 601 and (optional) reverse-image nomenclature 602. Mold 600 may optionally include flat areas (not shown) for receiving the faces of (optional) nameplates affixed to the reinforcing trusses 320-322. As will become apparent in view of the following description, projections 603-604 are used to form lift holes that expose lift rods in the upper surface of the resulting lid. The perimeter of mold 600 includes a raised lip 605, which is dimensioned to closely receive the upper edge 315 of plastic frame structure 310. In the described example, mold 600 has a thickness in the range of about ¼ inch to ½ inch, and the raised lip 605 has a height in the range of about ½ inch to 1 inch.

Figure 6B:
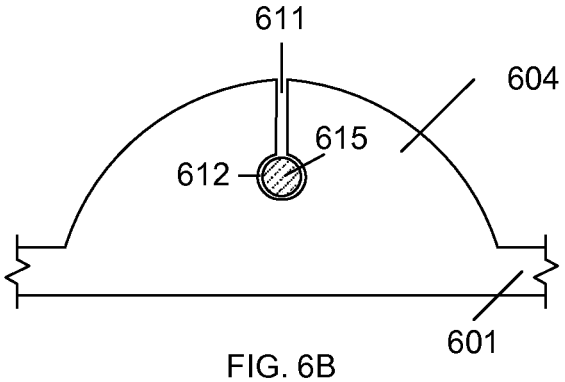
FIG. 6B is a side view of a projection of the mold of FIG. 6A in accordance with one embodiment of the present invention.

FIG. 6B is a side view of projection 604 in accordance with one embodiment of the present invention. Projection 604 includes a slot 611, which leads to a cylindrical opening 612. A rigid lift rod 615 is inserted through slot 611 and is fitted into cylindrical opening 612. The ends of the lift rod 615 extend past the ends of projection 604, such that when concrete is subsequently introduced to the reinforcing structure 300, the ends of the lift rod 615 are surrounded (and ultimately held) by the concrete. When the mold 600 is removed, lift rod 615 slides through slot 611, and remains embedded in the concrete.

Figure 7A:
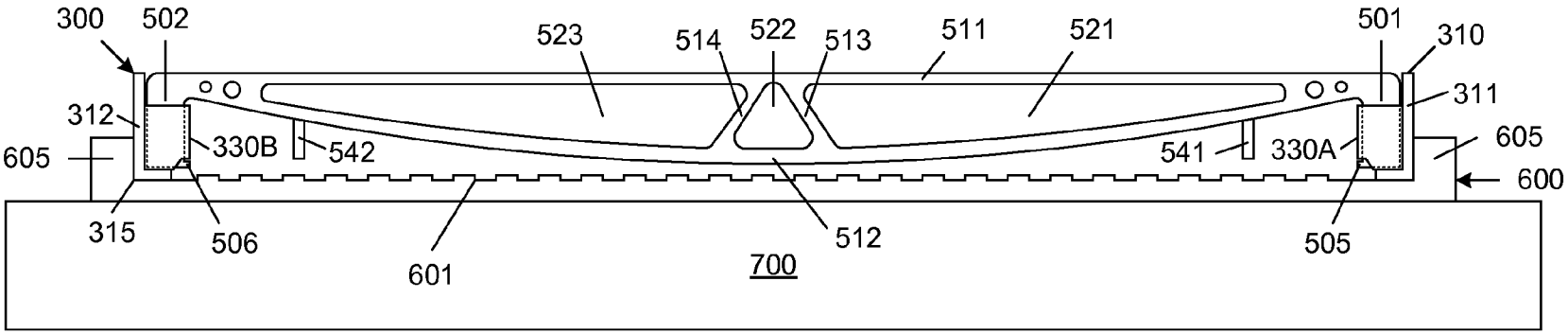
FIGS. 7A and 7B are cross sectional views of the reinforcing structure of FIGS. 3A-3B engaged with the mold of FIG. 6A, during various fabrication stages of a lid, in accordance with one embodiment of the present invention.

FIG. 7A is a cross sectional view of reinforcing structure 300 engaged with mold 600. The cross sectional view of FIG. 7A passes through reinforcing truss 320, as illustrated. Mold 600 is (optionally) placed on a flat platform 700, with the upper surface of mold 600 facing upward. Reinforcing structure 300 is then fitted into the raised lip 605 of mold 600, with the top edge 315 of plastic frame structure 310 pointed downward. The fit between the upper edge 315 of plastic frame structure 310 and raised lip 605 of mold 600 is sufficiently tight to allow wet concrete to be contained, without any additional support structures.

Figure 7B:
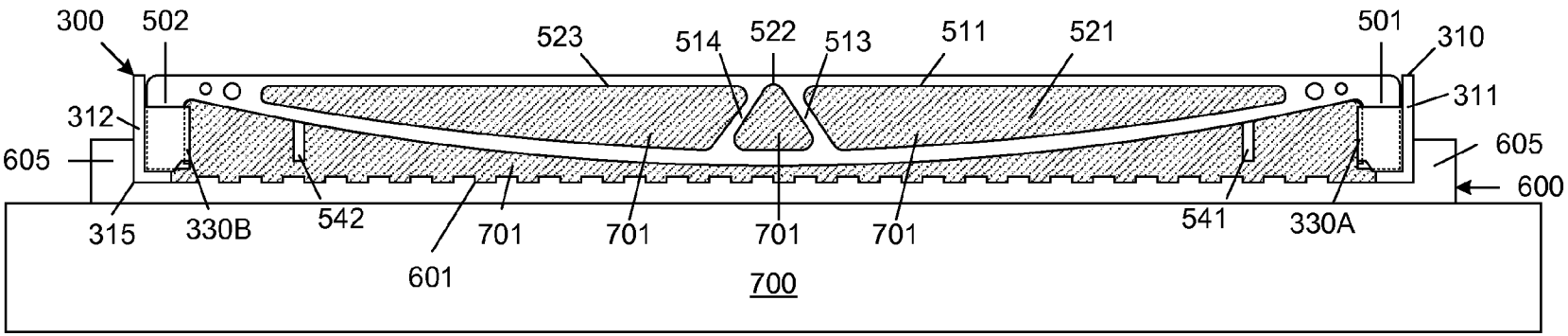

As illustrated in FIG. 7B, wet concrete 701 or other mix, generally including cement, is then poured into reinforcing structure 300 to a level approaching lower edge 316. In the described embodiment, a 5000# psi concrete mix is used. When the mix is sufficiently cured (thereby forming concrete core 701), mold 600 is separated from reinforcing structure 300 and concrete core 701. This separation can be implemented by pulling on the mold 600 by hand. Alternately, mechanical means can be used to pull mold 600 from reinforcing structure 300 and concrete core 701. The flexibility of mold 600 simplifies removal of this mold 600. Due to its resilient nature, mold 600 can be easily removed (and re-used) after concrete core 701 is cured. In some embodiments, the curing period is accelerated by heating, as with steam or another heat source, to shorten the curing period, and to permit faster turnaround and reuse of mold 600. The curing period can also be accelerated by mixing an additive into the wet concrete.

Figure 8:
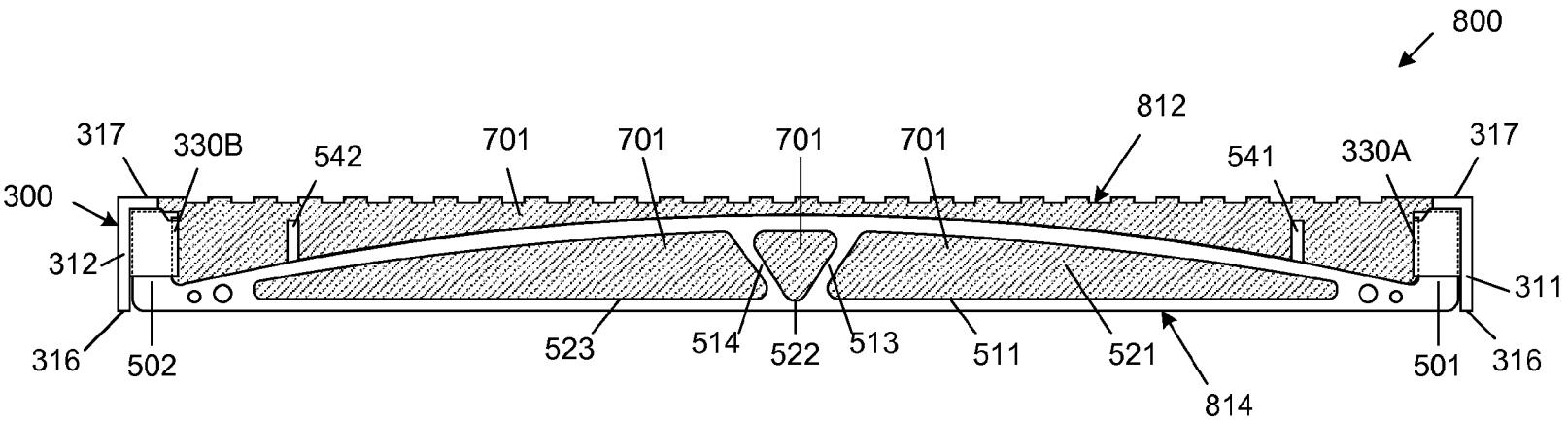
FIG. 8 is a cross sectional view of a lid that is formed by the process steps illustrated by FIGS. 7A and 7B, in accordance with one embodiment of the present invention.

FIG. 8 is a cross-sectional view of a utility enclosure lid 800, which results from the removal of mold 600. Lid 800, which includes reinforcing structure 300 and concrete core 701, may be warehoused for a period sufficient to fully cure the concrete, before installation in an in-ground utilities box. Note that mold 600 can be re-used in combination with another reinforcing structure to fabricate another lid.

Figure 9:
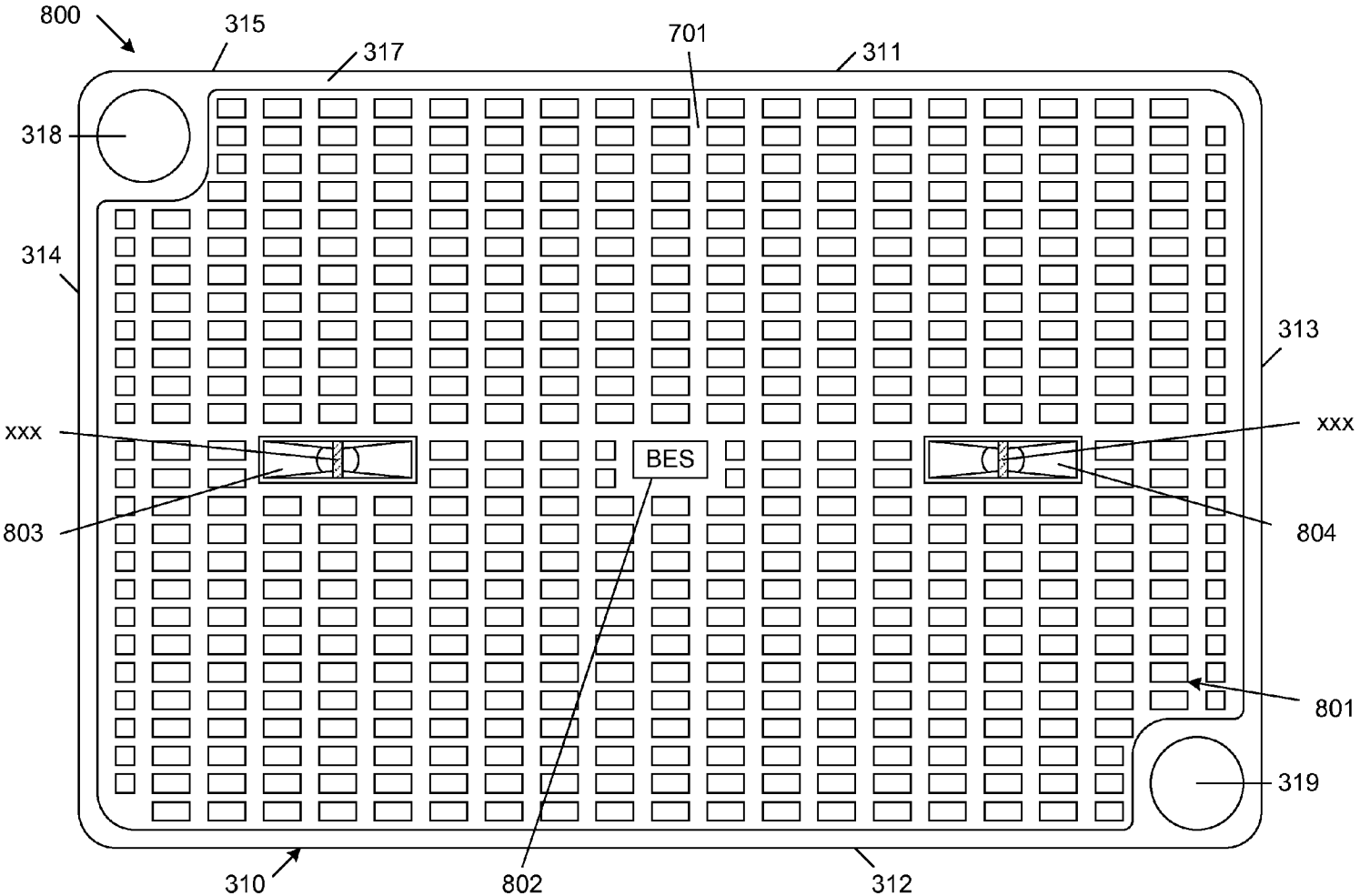
FIG. 9 is a top view of the lid of FIG. 8 in accordance with one embodiment of the present invention.
Figure 10:
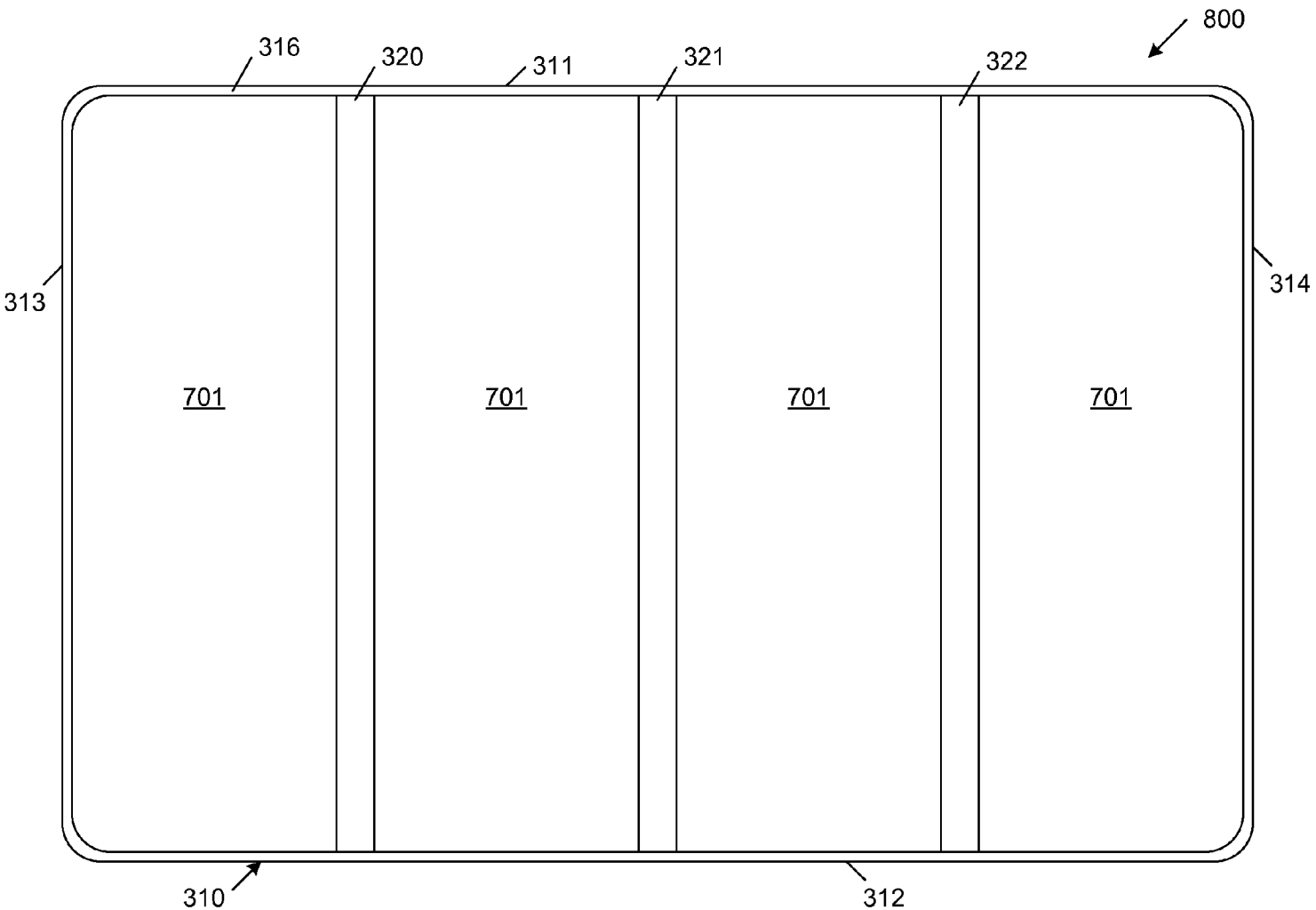
FIG. 10 is a bottom view of the lid of FIG. 8 in accordance with one embodiment of the present invention.

FIGS. 9 and 10 are top and bottom views, respectively, of lid 800. Lid 800 includes a rectangular upper surface 812 and a mutually opposing rectangular lower surface 814. The top surface 812 and the bottom surface 814 are substantially parallel to one another. Substantially all of the top surface 812 of lid 800 is exposed concrete, with the exception of the rolled edge 317 of plastic frame structure 310, which surrounds the exposed concrete at top surface 812. Similarly, substantially all of the bottom surface 814 of lid 800 is exposed concrete, with the exception of the lower edge 316 of plastic frame structure 310, which surrounds the exposed concrete at bottom surface 314, and the lower surfaces of the flat truss members (e.g., flat truss member 511) of reinforcing trusses 320-322.

The upper surface of concrete core 701 has a textured (non-skid) finish 801, which is introduced by the textured pattern 601 of mold 600. The upper surface of concrete core 701 also includes nomenclature 802, which is introduced by the reverse-pattern nomenclature 602 of mold 600. Nomenclature 802 may identify the manufacturer of lid 800 and/or the type of utility box on which the lid 800 is eventually fitted (e.g., 'electrical', 'water' or 'sewer'). The upper surface of concrete core 701 also includes lift rod holes 803 and 804, which are introduced by protrusions 603 and 604 or mold 600. These lift-rod holes 803 and 804 expose portions of lift rods 615-616 as illustrated. As a result, lift rods 615-616 can be engaged by hook elements, thereby enabling lid 800 to be easily lifted by lift rods 615-616. Lift rods 615-616 are advantageously located at a precise height below the upper surface of lid 800, due to the positioning of lift rods 615-616 provided by protrusions 603 and 604.

Note that the lower surfaces of reinforcing trusses 320-322 are exposed through concrete core 701 at the lower surface 814 of lid 800 (FIG. 10). In an alternate embodiment, reinforcing trusses 320-322 may be positioned higher within lid 800, such that these reinforcing trusses 320-322 are not exposed through concrete core 701 at the lower surface of lid 800.

Circumscribing sidewalls 311-314 and reinforcing trusses 320-322 provide reinforcement for the concrete core 701, thus eliminating the need for rebar or wire reinforcement in lid 800. Although the reinforcing structure 300 includes three reinforcing trusses 320-322 in the described examples, it is understood that other numbers of reinforcing trusses can be used in other embodiments. In accordance with one embodiment, the number of reinforcing trusses used is directly related to the size of the lid. In accordance with one embodiment, the reinforcing trusses are spaced equally along the length of the reinforcing structure 300. Thus, for a reinforcing structure 300 having a length of about 20 inches, the three reinforcing structures 320-322 are spaced about 5 inches from each other (center-to-center), and about 5 inches from sidewalls 313 and 314.

Reinforcement structure 300 provides significant protection to lid 800. Thus, lid 800 can be dropped from heights that would cause cracking or chipping of a conventional concrete lid, without adverse results. Plastic frame structure 310 prevents chipping and cracking of lid 800 as the lid is inserted into and removed from a corresponding utilities box during normal handling of lid 800. As a result, plastic frame structure 310 will also provide protection to the corresponding utilities box. In cold environments, the smooth surface of plastic frame structure 310 helps prevent ice from locking lid 800 in the opening of the corresponding utilities box.

Although the invention has been described in connection with several embodiments, it is understood that this invention is not limited to the embodiments disclosed, but is capable of various modifications, which would be apparent to a person skilled in the art. For example, although a concrete lid having a rectangular shape has been described, it is understood that the invention applies to lids having other shapes (and dimensions). The inventive principles may be applied to a wide range of boxes, vaults, and enclosures designed for underground use. Thus, the invention is limited only by the following claims.

We claim:

1. A lid for an in-ground utilities box, comprising:

a concrete core having an upper surface exposed at an upper surface of the lid and a lower surface exposed at a lower surface of the lid;

a plastic frame structure having a plurality of sidewalls laterally surrounding the concrete core; and one or more reinforcing trusses, each attached to a pair of opposing sidewalls of the plastic frame, wherein each of the one or more reinforcing trusses includes:

a first truss member that is substantially coplanar with the lower surface of the lid, and extends between the pair of opposing sidewalls; and a second truss member coupled to ends of the first truss member, adjacent to the pair of opposing sidewalls, wherein the second truss member forms an arch that extends between the ends of the first truss member, and extends toward the upper surface of the lid.

2. The lid of claim 1, wherein the one or more reinforcing trusses are not exposed at the upper surface of the lid.

3. The lid of claim 2, wherein the one or more reinforcing trusses are exposed at the lower surface of the lid.

4. The lid of claim 1, further comprising a plurality of connector elements formed on the pair of opposing sidewalls of the plastic frame, wherein each of the one or more reinforcing trusses is attached to the pair of opposing sidewalls of the plastic frame by the connector elements.

5. The lid of claim 4, wherein the connector elements comprise slots formed on the pair of opposing sidewalls of the plastic frame, wherein each of the one or more reinforcing trusses include ends that are fitted into the slots.

6. The lid of claim 1, further comprising one or more openings located between the first truss member and the second truss member of each of the one or more reinforcing trusses, wherein portions of the concrete core are located within the one or more openings.

7. The lid of claim 6, wherein each of the one or more openings has a triangular shape.

8. The lid of claim 6, further comprising one or more truss members connecting the first truss member to the second truss member.

9. The lid of claim 6, further comprising one or more gussets located along the second truss member.

10. The lid of claim 1, wherein the plastic frame structure and each of the one or more reinforcing trusses are made of the same material.

11. The lid of claim 1, wherein the sidewalls exhibit a rolled edge at the upper surface of the lid.

12. The lid of claim 1, wherein the first reinforcing truss is only attached to the plastic frame structure at the pair of opposing sidewalls.

13. The lid of claim 1, wherein the first reinforcing truss is substantially surrounded by the concrete core.

14. The lid of claim 1, wherein the plastic frame structure is a continuous structure, wherein the sidewalls extend from the upper surface of the lid to the lower surface of the lid.

15. The lid of claim 1, wherein the one or more reinforcing trusses are not exposed through the concrete core at the upper surface of the lid.

16. The lid of claim 11, wherein each of the one or more reinforcing trusses includes a pair of end posts coupled to the ends of the first truss member, wherein the end posts contact the rolled edge.

17. A reinforcement structure for a concrete lid comprising:

a plastic frame structure having a plurality of sidewalls that exhibit an upper edge and a lower edge;

one or more reinforcing trusses, each attached to opposing sidewalls of the plastic frame, wherein each of the one or more reinforcing trusses includes:

a first truss member that is substantially coplanar with the lower edge of the plastic frame structure, and extends between the pair of opposing sidewalls; and a second truss member coupled to ends of the first truss member, adjacent to the pair of opposing sidewalls, wherein the second truss member forms an arch that extends between the ends of the first truss member, and extends toward the upper edge of the plastic frame structure.

18. The reinforcement structure of claim 17, further comprising a plurality of connector elements formed on the opposing sidewalls of the plastic frame structure, wherein each of the one or more reinforcing trusses is attached to the opposing sidewalls of the plastic frame structure by the connector elements.

19. The reinforcement structure of claim 17, further comprising one or more openings located between the first truss member and the second truss member.

20. The reinforcement structure of claim 17, further comprising one or more truss members connecting the first truss member to the second truss member.

21. A method of forming a concrete lid for a utilities box, the method comprising:

attaching one or more reinforcing trusses to opposing sidewalls of a plastic frame, wherein the opposing sidewalls exhibit upper edges that define an upper surface of the lid, and lower edges that define a lower surface of the lid, and wherein each of the one or more reinforcing trusses includes a first truss member that is substantially coplanar with the lower edges of the opposing sidewalls when the one or more reinforcing trusses are attached to the opposing sidewalls, and a second truss member that forms an arch that extends between ends of the first truss member;

engaging the upper edges of the opposing sidewalls with a mold;

filling the plastic frame with concrete, wherein the concrete is contained by the plastic frame and the mold, wherein the concrete substantially surrounds the one or more reinforcing trusses;

curing the concrete, thereby creating cured concrete that bonds to the plastic frame and the one or more reinforcing trusses; and removing the mold from the plastic reinforcing structure and the cured concrete.

22. The method of claim 21, further comprising forming a pattern in the concrete with the mold.

23. The method of claim 21, further comprising forming one or more lift holes in the concrete with the mold.

* * * * *